United States Patent [19]

Phelps

[11] Patent Number: 4,541,187

[45] Date of Patent: Sep. 17, 1985

[54] SNOWBLOWER APPARATUS

[76] Inventor: W. Howard Phelps, 7528 Oakwood, Ralston, Nebr. 68127

[21] Appl. No.: 662,913

[22] Filed: Oct. 19, 1984

[51] Int. Cl.[4] ..... E01H 5/09

[52] U.S. Cl. ..... 37/251; 37/258

[58] Field of Search ..... 37/244, 246, 248–260, 37/209–213

[56] References Cited

U.S. PATENT DOCUMENTS

| | | | |
|---|---|---|---|
| 1,698,901 | 1/1929 | Zinn | 37/252 |
| 2,776,505 | 1/1957 | Root | 37/252 |
| 2,882,620 | 4/1959 | MacDonald | 37/252 |
| 3,045,369 | 7/1962 | Howe, Jr. | 37/252 |
| 3,213,552 | 10/1965 | Vanvick | 37/252 |
| 3,253,356 | 5/1966 | Haban | 37/252 |

*Primary Examiner*—E. H. Eickholt

*Attorney, Agent, or Firm*—Henderson & Sturm; Henderson & Sturm

[57] ABSTRACT

An improved snowblower apparatus having a housing unit (11), a power unit (12), a handle unit (13), a blade unit (14), a discharge unit (16) and a supplemental air inlet unit (17). The supplemental air inlet unit (17) comprises one or more holes disposed through the housing unit (11) to allow supplemental air to be introduced into the housing unit (11) so that it may be mixed with snow prior to being discharged. The housing unit (11) further includes a cutaway bottom section (26) to allow snow to engage the blade unit (14) without being first contacted by the bottom surface of the housing unit (11). The blade unit (14) can be easily removed from the housing unit (11) for ease of manufacture, replacement or repair.

4 Claims, 4 Drawing Figures

SNOWBLOWER APPARATUS

TECHNICAL FIELD

This invention relates generally to snowblowing apparatus.

BACKGROUND ART

Snowblowing apparatus of various kinds are well known in the prior art. Many of these structures having a housing unit that include a snow inlet portal, a rotating blade unit disposed within the housing unit for gathering snow and for discharging it, a power unit for powering the blade unit, and a discharge unit for directing the discharged snow as desired.

Various problems have arisen with respect to the manufacture, use and maintenance of these prior art structures. In general, the efficiencies of prior art snowblowers are not good. Generally, a fairly substantial power unit must be provided to obtain satisfactory operation, and this problem becomes particularly critical as the snow to be removed increases in depth. In addition, the manufacture of suitable blade units does not always proceed in a relatively simple or efficient fashion. Further, if a prior art blade unit breaks or otherwise becomes defective, repairing or changing the blade unit can be difficult. Even the housing units for prior art structures are less than adequately designed, in that the housing structures generally begin to shove snow ahead before the blade unit can act upon it. And further because of long flight augers needed to bring snow into the discharge area the friction causes wasted power, thereby decreasing the efficiency of the unit.

There therefore exists a need for an improved snowblower apparatus that will be capable of removing even deeply piled snow without requiring a large power unit. Such a snowblower should ideally have a blade unit that can be simply constructed and replaced, and that will be durable and efficient in use and provide effective snow removal capabilities.

DISCLOSURE OF INVENTION

These needs and others are substantially met through provision of the improved snowblower apparatus as described herein. This apparatus includes generally a housing unit, a power unit, a handle unit, and a cupped impeller blade unit, a discharge unit and a supplemental air inlet unit.

The housing unit has a generally circular shaped blade housing unit having a snow inlet portal formed at one end. A significant portion of the bottom section of the blade housing unit proximal the snow inlet portal has been cutaway, to allow the blade unit to act upon a greater quantity of previously undisturbed snow, and to prevent snow from having to be pushed ahead of a scoop bottom. The housing unit further includes a power unit mounting platform and a wheel assembly to allow the housing unit to be conveniently operated.

The power unit may be comprised of an appropriate electric motor or internal combustion engine. The motor or engine connects to a drive shaft through appropriate sprockets and a drive chain. In one embodiment of this invention as constructed by the applicant, a one-half horsepower electric motor provided sufficient power to adequately clear snow without undue compromise of speed or clearing performance.

The handle unit simply comprises an appropriate handle that may be attached to the housing unit to allow the housing unit to be more conveniently maneuvered about by an operator.

The blade unit includes a sleeve that may be fit about the drive shaft of the power unit, a support strut affixed forwardly on the sleeve, and two scoops disposed rearwardly of the sleeve and at perpendicular angles thereto. In addition, two curved blades connect between the support strut and the U-shaped scoops to aid in drawing snow in from the snow inlet portal of the blade housing unit back towards the two scoops that rotate and urge the collected snow towards the discharge unit. The path of the snow is only changed one time from the intake to the discharge.

The discharge unit includes a discharge portal formed through the housing unit and a rotatable spout that may be utilized to direct discharged snow in a desired direction with respect to the housing unit.

The supplemental air inlet unit comprises one or more openings formed in the rear surfaces of the housing unit. Contrary to what otherwise might be expected, snow drawn into the housing unit does not tend to escape through the supplemental air inlet unit. Rather, air is drawn into the housing unit through the supplemental air inlet unit where it is mixed with incoming blowing snow. Because the snow inlet portal is or can be blocked with snow, a supplemental air inlet unit is needed to provide for mixture of air with the snow. Such mixture enhances the blowing efficiencies of the apparatus, and allows a relatively small power unit to collect and discharge in a satisfactory manner snows of various types, including light, crusty and wet.

BRIEF DESCRIPTION OF THE DRAWINGS

These and other attributes of the invention will become more clear upon a thorough review and study of the following description of the best mode for carrying out the invention, particularly when reviewed in conjunction with the drawings, wherein.

BEST MODE FOR CARRYING OUT THE INVENTION

Figure 1:
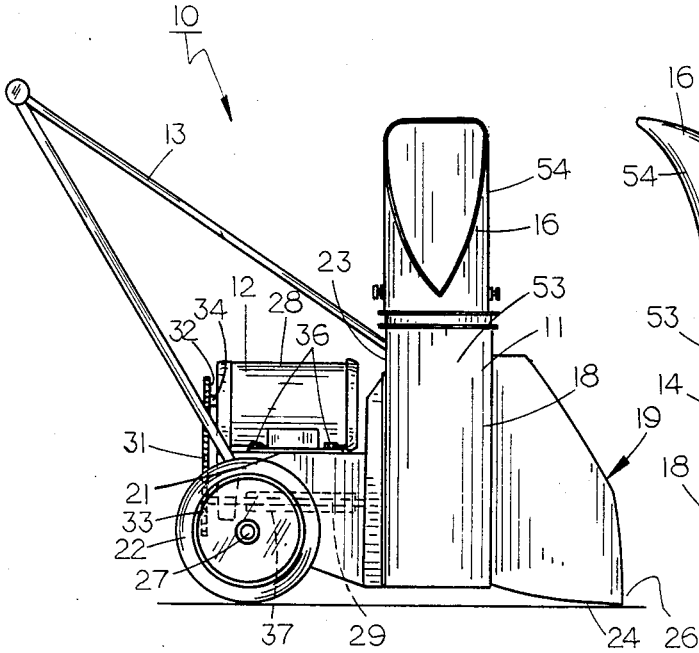
FIG. 1 comprises a side elevational view of the apparatus.
Figure 2:
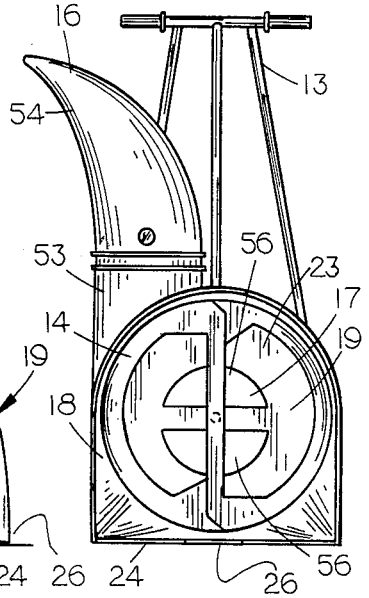
FIG. 2 comprises a front elevational view of the apparatus.

Referring now to the drawings, and in particular to FIG. 1, the apparatus of the invention can be seen as depicted generally by the numeral 10. The apparatus includes generally a housing unit (11), a power unit (12), a handle unit (13), a blade unit (14) (FIG. 2), a discharge unit (16) (FIG. 1) and a supplemental air inlet unit (7) (FIG. 2). Each of these generally described components will now be described in more detail in seriatim fashion.

With reference to FIGS. 1 and 2, the housing unit (11) can be seen to be comprised of a substantially circular blade housing unit (18) having a snow inlet portal (19), a power unit mounting platform (21) and a wheel assembly (22). The blade housing unit (18) may be comprised of metal and has a substantially closed rearward end (23) disposed distally to the snow inlet portal (19). The two holes disposed through the rear wall (23) are a part of the supplemental air inlet unit (17) and will be described in more detail below.

Figure 3:
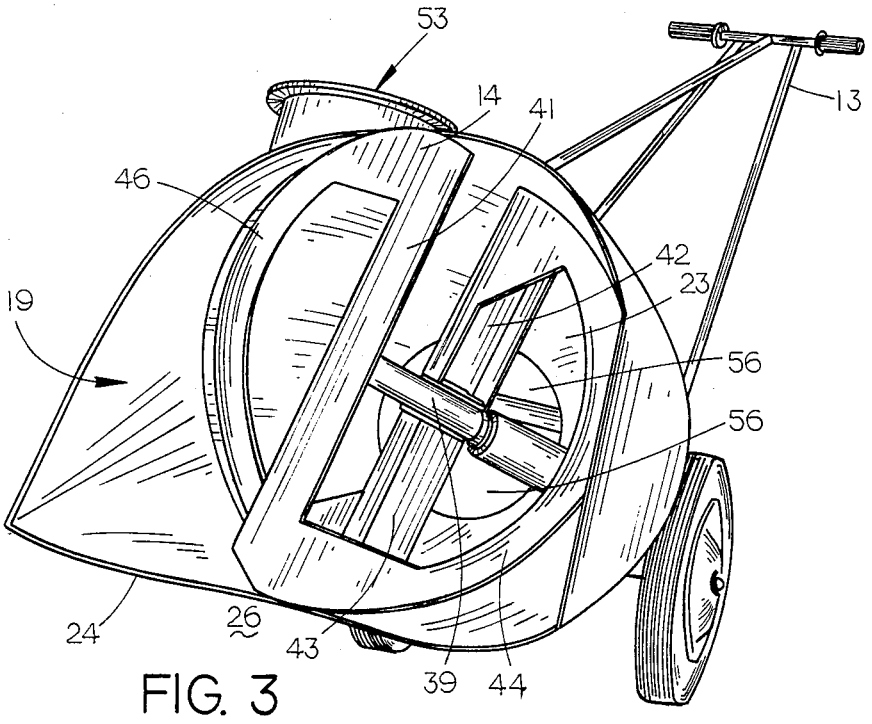
FIG. 3 comprises an enlarged perspective view of the apparatus.

With particular reference to FIGS. 2 and 3, it may be seen that the bottom surface (24) of the blade housing unit (18) proximal the snow inlet portal (19) has a cavity (26) formed therein. By provision of this cavity (26) on the bottom surface (24), snow to be removed can essentially be brought directly into contact with the blade unit (14), and the bottom surface (24) will not unduly interfere or push the snow out of the way.

With reference to FIG. 1, the power unit mounting platform (21) simply comprises a substantially horizontal platform that has been secured to the blade housing unit (18). Holes are provided through the power unit mounting platform (21) to facilitate mounting the power unit (12) thereon.

Finally, the wheel assembly (22) comprises two wheels rotatably disposed about an axle (27) and that are operably affixed to the housing unit (11). The wheel assembly (22) has been located rearwardly of the blade housing unit (18). If desired, more wheels could be utilized, or such wheels could be located in different positions. In addition, such wheels could be connected to a power source to enable the apparatus (10) to be self-propelled.

With reference to FIG. 1, the power unit (12) includes a motor or engine (28), a drive shaft (29), a drive chain (31) and two sprockets (32 and 33). In the embodiment depicted, a one-half horsepower 110 volt electric motor (28) has been provided that produces 1,750 r.p.m. at its output shaft (34). This motor (28) can be affixed to the housing unit (11) by use of bolts (36) or the like as used in conjunction with the power unit mounting platform (21).

The drive shaft (29) fits through a sleeve (37) that mounts to the housing unit (11). One sprocket (32) connects to the output shaft (34) of the motor (28), and the remaining sprocket (33) connects to one end of the drive shaft (29). The drive chain (31) may then be suitably disposed about the two gears (32 and 33), such that when the output shaft (34) of the motor (28) rotates, the drive shaft (29) will also rotate. In the particular embodiment depicted, the applicant has provided a gear ratio such that the drive shaft (29) will rotate at 1,050 revolutions per minute.

If desired, a protective cowling (not shown) may be provided about the drive chain (31) to prevent fouling of the chain (31) or other potential damage.

With reference to FIG. 1, the handle unit (13) may be comprised of any suitable extension such that an operator can propel and maneuver the apparatus (10) from a substantially upright position. In the embodiment depicted, the handle unit (13) includes three metal rods that affix at their lower ends to the housing unit (11) and that are connected at their upper ends to a perpendicular bar that an operator may grasp.

Figure 4:
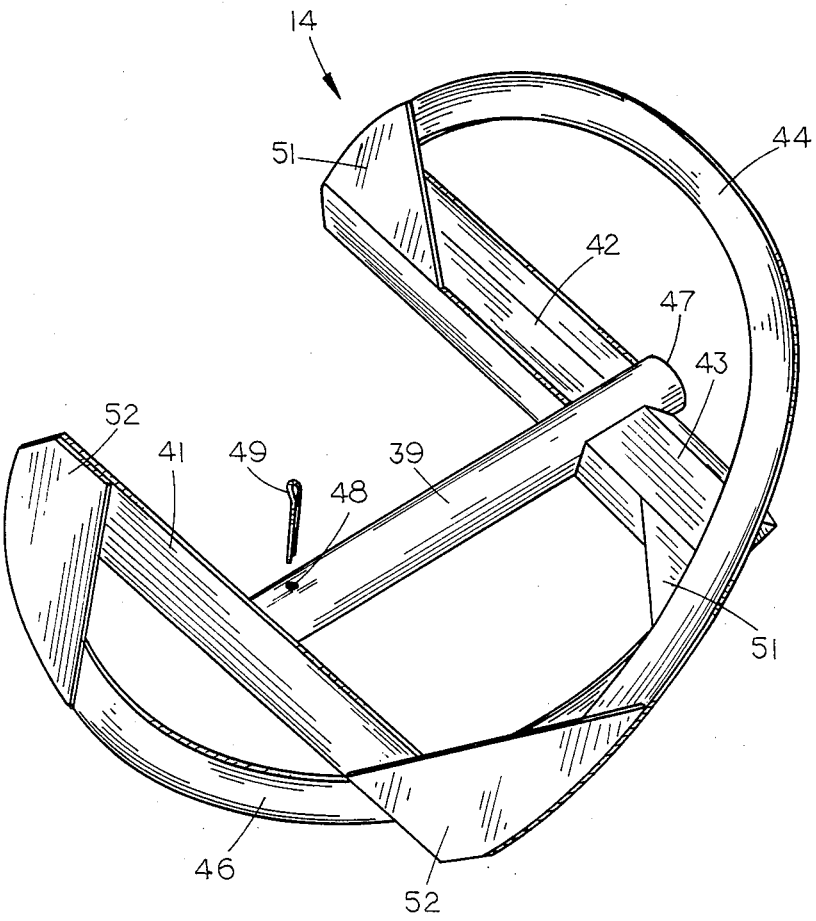
FIG. 4 comprises an enlarged perspective view of the blade and cupped impeller unit.

Referring now to FIGS. 3 and 4, the blade unit (14) includes generally a sleeve (39), a support strut (41), two scoops (42 and 43), and two curved blades (44 and 46). The sleeve (39) has a hollow interior and an open rearward end (47). The interior diameter of the sleeve (39) should be sufficiently large to allow the sleeve (39) to be slidably disposed about the drive shaft (29) of the power unit (12). A hole (48) has been radially disposed through the sleeve (39) proximal its forward end to allow a pin (49) or the like to be disposed through this hole (48) and through a hole that may be provided in the forward end of the drive shaft (29).

The support strut (41) comprises a rectangular member perpendicularly affixed to the forward end of the sleeve (39).

The two scoops or impellers (42 and 43) are each comprised of metal members that are perpendicularly affixed at one end to the rearward end of the sleeve (39). Each member has been curved about its longitudinal axis, with the concavity of one scoop (42) being disposed opposite the concavity of the remaining scoop (43).

The two curved blades (44 and 46) are each connected at one end to the support strut (41) and at the remaining end to a scoop (42 or 43). To accommodate this orientation, each curved blade (44 and 46) has been smoothly contoured rearwardly from the support strut (41), much like flighting on an auger.

It should be further noted that the connection between the curved blades (44 and 46) and the two scoops (42 and 43) includes a scoop flange area (51), and the connection between the two curved blades (44 and 46) and the support strut (41) includes a support strut flange (52). The scoop flanges (51) and the support strut flanges (52) provided added strength to the juncture between the support strut (41) and the curved blades (44 and 46) and the two scoops (42 and 43) and the two curved blades (44 and 46), and further enhance the scoop like action of the two scoops (42 and 43) during operation of the apparatus (10).

Referring now to FIGS. 1 and 2, the discharge unit (16) includes a discharge portal (53) formed through the upper surface of the blade housing unit (18), and a rotatable spout (54) operably disposed with respect to the discharge portal (53). The discharge portal (53) should be located in the same plane as the two scoops (42 and 43). In the embodiment depicted, the rotatable spout (54) may be rotated with respect to its central axis to selectively adjust the direction that snow being discharged from the interior of the blade housing unit (18) will travel. If desired, suitable cables or the like could be provided to allow the rotatable spout (54) to be controlled by the operator from a remote position.

Finally, with reference to FIGS. 2 and 3, the supplemental air inlet unit (17) comprises two semi-circular openings (56) disposed through the rearward wall (23) of the blade housing unit (18). These openings (56) are positioned on either side of the drive shaft (29). Such supplemental air inlet openings could be located in other positions, and could be provided through use of more openings, or fewer openings. Such auxiliary openings, however, should be provided other than near the snow inlet portal (19) and are noncontiguous with the snow inlet portal (19).

Operation of the apparatus (10) will now be described.

The power unit (12) may be activated to cause the drive shaft (29), and hence the blade unit sleeve (39), to rotate. Such rotation will cause the support strut (41) and the two scoops (42 and 43) to rotate as well, which in turn will force rotational movement of the two curved blades (44 and 46).

With the blade unit (14) so rotating, the apparatus (10) may be moved towards the snow to be removed in order to bring the snow into contact with the blade unit (14). As the blade unit encounters snow, the two curved blades (44 and 46) aid in drawing the snow rearwardly towards the two scoops (42 and 43). The two scoops then act in concert with the curved interior surface of the blade housing unit (18) to discharge the snow through the discharge portal (53). The discharged snow may then be appropriately directed through use of the rotatable spout (54).

Contrary to what might be expected, snow does not tend to exit from the blade housing unit (18) through the supplemental air inlet unit (17). Rather, air enters the blade housing unit (18) through these openings (56). With particularly deep snow, and particularly where snow is of a height equal to or greater than the height of the snow inlet portal (19) of the housing unit (11), air enters through the supplemental air inlet unit (17) and mix with snow in the blade housing unit (18). This appears to greatly enhance the operating efficiency of the apparatus (10), and allows the apparatus (10) to efficiently and adequately clear deposited snow with a relatively small power unit (12).

It should be further appreciated that the blade unit (14) can be easily installed or removed from the drive shaft (29) through simple manipulation of the pin (49). This allows the blade unit (14) to be simply manufactured and easily repaired if necessary.

Obviously, numerous modifications and variations of the present invention are possible in light of the above teachings. It is therefore to be understood that within the scope of the appended claims, the invention may be practised otherwise than as specifically described therein.

I claim:

1. In a snowblower apparatus having a housing unit with a snow inlet portal, a blade unit at least partially disposed in said housing unit such that said blade unit can rotate in order to collect snow and discharge said snow from said housing unit, a power unit for providing power to said blade unit, and a discharge unit to direct said discharged snow, an improvement comprising providing said power unit with a drive shaft and providing said blade unit with a sleeve that may be disposed about said drive shaft and affixed thereto to allow said drive shaft to cause said blade unit to rotate, wherein said blade unit includes at least two curved blades disposed as flighting about said blade unit, and wherein one end of each said curved blade connects to a support strut affixed to a forward end of said blade unit and the remaining ends of each said curved blade affixed via a generally triangular brace element to the outboard ends of generally U-shaped scoops having one end affixed perpendicularly to said remaining ends of each said curved blade, and having their other ends radially disposed on said sleeve.

2. The improvement of claim 1 further comprising a supplemental air inlet unit disposed other than contiguously with said snow inlet portal to allow air to be introduced into said housing unit for mixing with said snow to be discharged.

3. The improvement of claim 2 wherein said supplemental air inlet unit comprises at least one hole disposed through a rearward surface of said housing unit, said rearward surface being disposed substantially distal said snow inlet portal.

4. The improvement of claim 3 wherein said supplemental air inlet unit comprising two semi-circular shaped holes disposed through said rearward surface.

* * * * *